United States Patent [19]

Matsumoto et al.

[11] 4,018,154

[45] Apr. 19, 1977

[54] PRINTING APPARATUS FOR CASH REGISTER

[75] Inventors: Jyusei Matsumoto; Minoru Itoh; Chuzi Ishikawa; Yoshio Hashimoto, all of Tokyo, Japan

[73] Assignee: Ricoh Co., Ltd., Tokyo, Japan

[22] Filed: Feb. 11, 1975

[21] Appl. No.: 549,118

[30] Foreign Application Priority Data

Feb. 14, 1974 Japan ..... 49-17104

[52] U.S. Cl. ..... 101/93.02; 101/99; 101/93.35; 101/287

[51] Int. Cl.[2] ..... B41J 9/02

[58] Field of Search ..... 101/93.02, 93.35, 93.36, 101/93.41, 93.48, 93.31, 287, 95, 316, 99, 317; 235/58 P, 60 P

[56] References Cited

UNITED STATES PATENTS

| | | | |
|---|---|---|---|
| 2,353,057 | 7/1944 | Mills | 101/93.02 |
| 2,616,366 | 11/1952 | Eickman | 101/93.02 |
| 2,625,100 | 1/1953 | William et al. | 101/93.02 |
| 2,821,135 | 1/1958 | Larrabee | 101/287 |
| 3,601,204 | 8/1971 | Denley | 101/93.35 X |
| 3,616,994 | 11/1971 | Watanabe et al. | 101/93.36 X |
| 3,874,287 | 4/1975 | Aldea | 101/93.48 |

FOREIGN PATENTS OR APPLICATIONS

| | | | |
|---|---|---|---|
| 2,053,387 | 5/1971 | Germany | 101/93.02 |

*Primary Examiner*—Edward M. Coven
*Attorney, Agent, or Firm*—Frank J. Jordan

[57] ABSTRACT

Printing apparatus particularly suited to a cash register includes a hammer arranged to move printing paper into engagement with type wheels located on the other side of the paper. A cam and linkage move the hammer into and out of contact with the paper. Strong springs are provided to rapidly accelerate the hammer toward the paper through an engaging plate. The engaging plate is stopped before the hammer contacts the paper, and the hammer strikes the paper due to its inertia. The hammer rebounds off the paper and is caught and held by the linkage in the rebound position between the paper and the engaging plate to prevent double printing.

6 Claims, 5 Drawing Figures

PRINTING APPARATUS FOR CASH REGISTER

The present invention relates to a printing mechanism particularly suited to a cash register by which high impression pressure may be provided without double printing.

A prior art printing apparatus to which the invention is applicable includes a hammer arranged to strike against printing paper for printing. Type wheels and carbon paper are arranged on the opposite side of the paper so that the hammer moves the printing paper and carbon paper against the type wheels so that the characters or numerals on the type wheels are printed on the paper. Such apparatus is commonly found in a cash register. It is sometimes desirable to print using a low striking force or impression pressure such as when performing simple printing. However, it is desirable to use a higher striking force or impression pressure such as when making several copies of a bill.

The prior art includes printing apparatus in which the hammer is forced against the paper and type wheels by a cam. Such apparatus is suitable for providing low striking force and prevents double striking, but is not adaptable to provide high striking force. In other known apparatus to provide high striking force, a cam is provided to move the hammer away from the paper against strong springs. As the cam follower drops abruptly from a high part of the cam to a low part thereof, the hammer is moved by the springs to strike the paper with a strong force. Double printing is a particular problem in this type of apparatus, and a proposed solution involves moving the cam during the rebound period of the hammer so that the cam follower engages with a higher portion of the cam after rebound and the hammer is thereby held away from the paper. However, due to the high impression pressure required, the strong springs cause highly rapid rebound with low displacement. The operability of such an apparatus is therefore severely limited by the speed of rotation of the cam, in that it is only effective at extremely high cam speeds. Also, the cam tends to wear rapidly.

It is therefore an important object of the present invention to provide printing apparatus particularly suited to a cash register in which any desired striking force or impression pressure may be provided without double printing.

It is another object of the present invention to provide printing apparatus comprising a printing member such as a hammer arranged to strike printing paper to perform printing, in which the hammer rebounds off the paper and is caught and held by catching means to prevent double printing.

The above and other objects, features and advantages of the present invention will become clear from the following detailed description taken with the accompanying drawings, in which.

Figure 1:
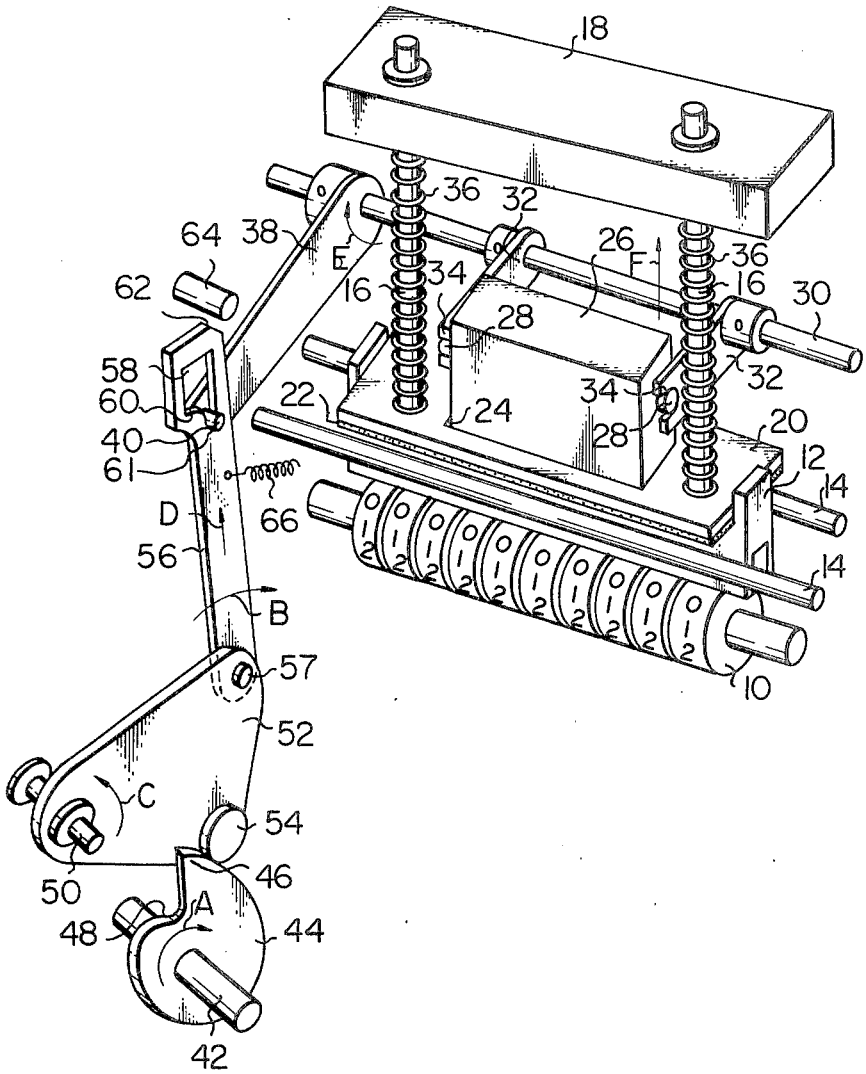
FIG. 1 is a perspective view of printing apparatus embodying the present invention.

Referring now to FIG. 1, printing apparatus embodying the present invention, which may be utilized in a cash register (not shown), comprises a type drum 10 formed of a plurality of rotatable type wheels (not designated) on which characters such as numerals and symbols are provided, which are selectably rotated by the cash register mechanism. A printing member here shown as a hammer 12 is guided by stopper rods 14 toward and away from the type drum 10. Guide rods 16 are fixed to the top of the hammer 12 and slidably extend through holes (not designated) in a support 18 to further guide the hammer 12. An engaging member comprising a plate spring 20 and a cushion 22 engagable with the top of the hammer 12 is provided with holes (not designated) through which the guide rods 16 slidably extend. Compression springs 36 are coiled around the rods 16 between the support 18 and plate spring 20 to urge the spring 20 and cushion 22 toward the stopper rods 14. The engaging member is formed with a hole 24 through which a projection 26 of the hammer 12 extends. Pins 28 are fixed to the ends of the projection 26. A rotary shaft 30 carries arms 32 formed with slots 34 in their ends in which the pins 28 are slidably received.

The shaft 30 also carries a link or arm 38, which has a pin 40 fixed to its end. A camshaft 42 is connected to a motor through a one-rotation clutch of the cash register (not shown) and carries a disc cam 44. The diameter of the periphery of the cam 44 increases from a low portion 48 to a high portion 46 in the direction opposite to an arrow A, with an abrupt drop being provided between the high portion 46 and the low portion 48.

A rotary shaft 50 carries a bell crank lever 52, which has a cam follower or roller 54 attached to its lower end engaging with the cam 44. A link 56 is pivotally connected to the upper end of the lever 52 by a pin 57, and is formed with a slot 58 in which the pin 40 of the arm 38 is slidably received. The lever 52, link 56, arm 38, shaft 30 and arms 32 constitute a linkage connecting the cam 44 to the hammer 12. The slot 58 is provided with a shoulder 60 spaced slightly from its lower end 61. The upper right edge (as viewed in FIG. 1) of the link 56 is formed as an inclined portion 62 adapted to engage with a fixed pin 64. A tension spring 66 pivotally urges the link 56 in the direction of an arrow B. The link 56 formed with the slot 58, the spring 66 and the arm 38 carrying the pin 40 constitute catching means, and the pin 64 constitutes release means to release and reset the catching means as will be understood from the description below.

Figure 2:
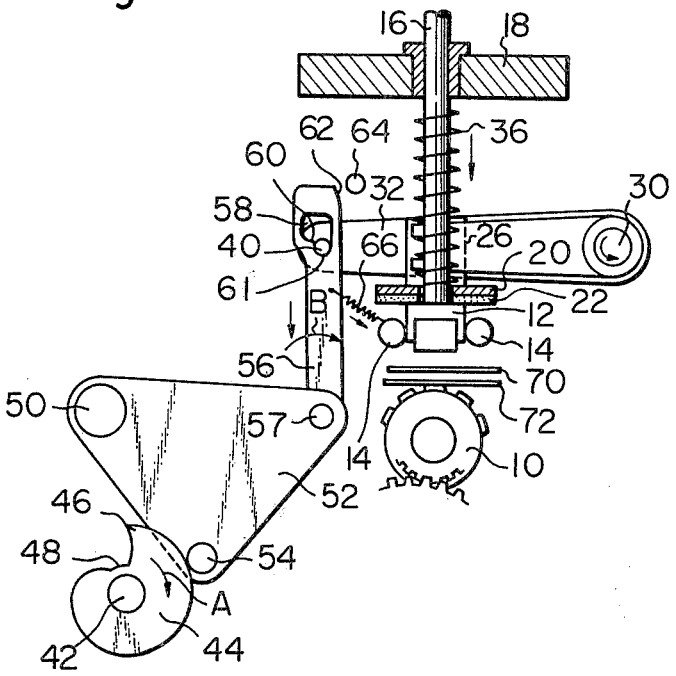
FIG. 2 is an elevation, partly in section, of the apparatus shown in FIG. 1.
Figure 3:
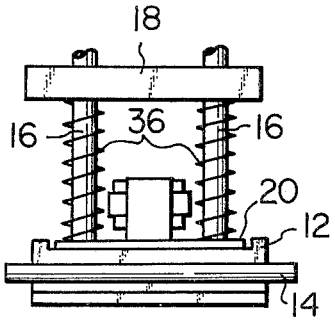
FIG. 3 is a fragmentary longitudinal view of the apparatus shown in FIG. 1.

In operation, the apparatus is normally in a standby for printing condition shown in FIGS. 1, 2 and 3. A printing medium comprising printing paper 70 and carbon paper 72 is placed between the hammer 12 and type drum 10. The roller 54 engages with the high portion 46 of the cam 44, the cam 44 being held stationary, and the hammer 12 is held out of engagement with the paper 70 and drum 10. The cushion 22 is disengaged from the stopper rods 14, and the upper surface 12*a* (see FIG. 4) of the hammer 12 is engaged with the cushion 22. In this manner, the plate spring 20, cushion 22, hammer 12 and rods 16 are urged toward the drum 10 in the direction opposite to an arrow F (parallel to the rods 16) by the springs 36. These members are prevented from moving toward the drum 10 by the arms 32 holding the pins 28 of the projection portion 26 of the hammer 12 by means of the slots 34. The shaft 30 carrying the arms 32 is prevented from movement by the arm 38 fixed thereto, by means of the pin 40 seated at the end 61 of the slot 58 of the link 56. The link 56 is held by the lever 52 by means of the roller 54 engaging with the high portion 46 of the cam 44.

To perform printing, the cash register operator depresses the proper key so that the one-rotation clutch (not shown) causes the shaft 42 and cam 44 to rotate by one revolution in the direction of the arrow A. As the roller 54 approaches the highest part of the cam 44, the lever 52 rotates in the direction of an arrow C, the link 56 moves in the direction of an arrow D, the arm 38, shaft 30 and arms 32 are rotated in the direction of an arrow E by means of the pin 40 engaged in the end 61 of the slot 58, and the hammer 12, cushion 22, plate spring 20 and rods 16 are further moved in the direction of the arrow F against force of the springs 36 so that the hammer 12 even further moves away from the drum 10.

Figure 4:
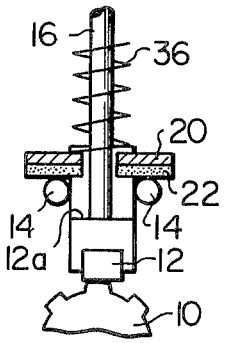
FIG. 4 is a fragmentary elevation of the apparatus shown in FIG. 2 illustrating the operation thereof.

As the roller 54 moves off the top of the high portion 46 and drops toward the low portion 48 of the cam 44, the force of the springs 36 causes the plate spring 20, cushion 22 and hammer 12 to accelerate strongly toward the drum 10. The pins 28 cause the arms 32, shaft 30, arm 38 and pin 40 to rotate opposite to the direction of the arrow E. The pin 40 causes the link 56 to move opposite to the direction of the arrow D and the lever 52 and roller 54 to rotate opposite to the direction of the arrow C. The cushion 22 abuts against the stopper rods 14 and the cushion 22 and plate spring 20 are prevented from further movement. The hammer 12 continues movement toward the drum 10 due to inertia and gravity, as shown in FIG. 4, as it is free from the force of the springs 36.

Figure 5:
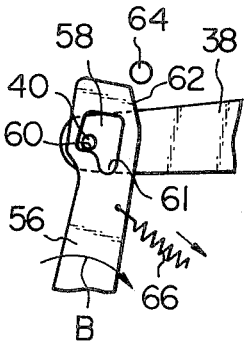
FIG. 5 is a fragmentary elevation of another part of the apparatus shown in FIG. 2 illustrating the operation thereof.

The hammer 12 engages with the printing paper 70 and moves the paper 70 and the carbon paper 72 against the printing surface or type on the type drum 10 to perform printing. The hammer 12 then rebounds from the paper 70. As shown in FIG. 5, movement of the arm 38 in the direction of the arrow E caused by the rebound of the hammer 12 causes the pin 40 to move in the slot 58 away from the end 61 to align with the shoulder 60. The spring 66 then pivots the link 56 in the direction of the arrow B so that the pin 40 moves onto the shoulder 60 and is held thereon. When the roller 54 engages with the low portion 48 of the cam 44, the hammer 12 is held by means of the shoulder 60 and the pin 40 in a position between the paper 70 and the cushion 22 to positively prevent double printing. As the cam 44 rotates so that the roller 54 moves from the low portion 48 toward the high portion 46, the lever 52 is rotated in the direction of the arrow C, the link 56 is moved in the direction of the arrow D, the pin 40, arm 38, shaft 30 and arms 32 are rotated in the direction of the arrow E and the hammer 12 is moved away from the drum 10 in the direction of the arrow F. Before the upper surface 12*a* of the hammer 12 engages with the cushion 22, the inclined portion 62 of the link 56 engages with the pin 64 and is forced thereby to rotate opposite to the direction of the arrow B. This causes the pin 40 to move off the shoulder 60 and drop down to the end 61. Further rotation of the cam 44 causes the upper surface 12*a* of the hammer 12 to engage with the cushion 22 so that the hammer 12, cushion 22 and plate spring 20 are moved against the force of the springs 36 to the positions shown in FIG. 1 at which the one-rotation clutch causes the cam 44 to stop rotation.

The novel and desirable features of the present invention are readily apparent. Due to the provision of the link 56 with the slot 58 and the arm 38 with the pin 40 in conjunction with the pin 64, double printing is positively prevented even if the springs 36 are very strong to provide a high impression pressure. One skilled in the art will immediately recognize that the support 18 may be moved parallel to the rods 16 to vary the preload of the springs 36 and thereby the striking force of the hammer 12 and the impression pressure. The wear on the shoulder 60 of the slot 58 of the link 56 is negligible since the movement of the pin 40 onto and off the shoulder 60 occurs at times when the force of the springs 36 is removed from the hammer 12. Since the hammer 12 is free from the force of the springs 36 when it strikes the paper 70, a proper and large rebound is possible to ensure the operation of the double strike preventing means. It is also obvious that the type drum 10 may be replaced with a cylindrical or flat platen, in which case the printing surface or type would be formed on the bottom of the hammer 12, as in a typewriter. In this case, the relative positions of the printing paper 70 and carbon paper 72 would be reversed.

What is claimed is:

1. Printing apparatus comprising, in combination:

a printing member engageable with a printing medium to perform printing;

a mechanism for moving the printing member into and out of engagement with the printing medium, the mechanism including biasing means to resiliently urge the printing member to engage with the printing medium in a manner causing the printing member to rebound from the printing medium after engagement therewith, an engaging member being releasably disposed between the biasing means and the printing member, said engaging member being mounted for movement towards and away from said printing member, and a stopper member disposed in a position spaced from said printing member and arranged to stop movement of the engaging member before the printing member engages with the printing medium so that the printing member is accelerated toward the printing medium by the biasing means through the engaging member and the printing member continues movement due to inertia to engage with the printing medium after the engaging member is stopped by the stopper member;

catching means operable to catch the printing member upon rebound from the printing medium and hold the printing member between a position in contact with the printing medium and a position in contact with the engaging member;

release means engageable with the mechanism and catching means to release and reset the catching means; and a motor driven cam shaft carrying a cam, said cam being operably connected to said mechanism for initiating actuation of said mechanism, whereby rotation of said cam causes said mechanism to effect said movement of said printing member into engagement with the printing medium.

2. The printing apparatus according to claim 1, in which the catching means comprises a linkage connecting the cam with the printing member, the linkage comprising a first link engaging with and reciprocally driven by the cam and a second link connected to the printing member, the first link being formed with a slot, the second link carrying a pin slidable in the slot of the first link and normally engaging with one end of the slot to move the printing member out of engagement with the printing medium, the slot being formed with a shoulder spaced from said end and the catching means further comprising a biasing member pivotally urging the first link in a direction so that the shoulder of the slot is urged to engage with the pin, the release means comprising a fixed release member engageable with the first link in a manner such that when rebound of the printing member causes the second link to move so that the pin moves from said end of the slot to a position aligned with the shoulder, the first link is pivoted by the biasing member so that the shoulder engages with the pin to retain the pin, and that as the cam moves the first link in a direction to move the printing member away from the printing medium, the first link engages with and is forced to pivot by the release member in a direction so that the pin moves from the shoulder to said end of the slot.

3. The printing apparatus according to claim 2, in which the linkage further comprises a lever pivotable about a fixed point and carrying at one end a cam follower engaging with the cam, another end of the lever being operatively connected to the first link.

4. The printing apparatus according to claim 1, in which the engaging member includes a plate engaging with the biasing means and a cushion member engageable with the stopper member.

5. The printing apparatus according to claim 1, in which the printing member is a hammer, and the apparatus further includes a member having a printing surface, the printing medium being disposed between the hammer and the printing surface so when the hammer engages with the printing medium the printing medium is moved into engagement with the printing surface to perform printing.

6. The printing apparatus according to claim 1, in which said engaging member is provided with an opening, a portion of the printing member extending through the opening in the engaging member, the mechanism being at least partially connected to said portion.

* * * * *